US007229067B2

(12) United States Patent
Dimarzo et al.

(10) Patent No.: US 7,229,067 B2
(45) Date of Patent: Jun. 12, 2007

(54) FOAM-GENERATING ASSEMBLY AND FOAM GENERATOR USED THEREIN

(75) Inventors: Marino Dimarzo, Bethesda, MD (US); John Gunderson, Mesa, AZ (US)

(73) Assignee: University of Maryland, College Park, MD (US)

( * ) Notice: Subject to any disclaimer, the term of this patent is extended or adjusted under 35 U.S.C. 154(b) by 75 days.

(21) Appl. No.: 11/117,716

(22) Filed: Apr. 29, 2005

(65) Prior Publication Data

US 2005/0263297 A1 Dec. 1, 2005

Related U.S. Application Data

(60) Provisional application No. 60/566,327, filed on Apr. 29, 2004.

(51) Int. Cl.
*B01F 3/04* (2006.01)
*A62C 35/00* (2006.01)

(52) U.S. Cl. ..... 261/79.2; 261/53; 261/100; 261/DIG. 26; 169/15

(58) Field of Classification Search ..... 261/53, 261/59, 79.1, 79.2, 100, DIG. 26; 169/15, 169/44

See application file for complete search history.

(56) References Cited

U.S. PATENT DOCUMENTS

| | | | | | |
|---|---|---|---|---|---|
| 1,874,209 | A * | 8/1932 | Schnabel | 261/83 |
| 2,492,037 | A * | 12/1949 | Freeman et al. | 261/116 |
| 2,774,583 | A * | 12/1956 | Haftke | 261/76 |
| 3,342,271 | A * | 9/1967 | Anthony, Jr. | 169/15 |
| 3,428,985 | A * | 2/1969 | Boyd | 15/50.3 |
| 4,318,443 | A | 3/1982 | Cummins | |
| 4,505,431 | A | 3/1985 | Huffman | |
| 4,830,790 | A * | 5/1989 | Stevenson | 261/18.1 |
| 4,901,925 | A | 2/1990 | Blake | |
| 4,925,109 | A | 5/1990 | Flanagan et al. | |
| 5,156,307 | A | 10/1992 | Callahan | |
| 5,382,389 | A * | 1/1995 | Goodine et al. | 261/18.1 |
| 5,404,957 | A * | 4/1995 | McCormack | 169/70 |
| 5,427,181 | A | 6/1995 | Laskaris et al. | |
| 5,881,817 | A | 3/1999 | Mahrt | |
| 6,112,811 | A | 9/2000 | Henry | |
| 6,267,183 | B1 | 7/2001 | Smagac | |
| 6,536,685 | B2 * | 3/2003 | Bennett | 239/343 |
| 6,543,547 | B2 | 4/2003 | Neumeir | |
| 2001/0042761 | A1 * | 11/2001 | Ophardt et al. | 222/190 |

* cited by examiner

*Primary Examiner*—Scott Bushey
(74) *Attorney, Agent, or Firm*—Dykema Gossett PLLC

(57) ABSTRACT

A foam-generating assembly for use in generating a nitrogen-containing foam useful in preventing or extinguishing fires includes a foam generator, a first tank containing a foamable aqueous liquid and a second tank containing nitrogen gas, the foam generator including a header which is hollowed out to provide a swirl chamber defined by an outer cylindrical wall, an inner cylindrical wall and a floor, a spray nozzle in the center of the floor for spraying foamable aqueous liquid supplied from the first tank, and an orifice in the inner cylindrical wall to supply a tangential flow of nitrogen gas from the second tank into the swirl chamber and around the spray nozzle and the liquid spray emitted therefrom and provide a vortex flow of a mixture of foamable aqueous liquid and nitrogen gas. First and second foaming screens are provided through which the vortex flow passes to provide first a coarse nitrogen-containing foam and then a fine nitrogen-containing foam. The first foaming screen can be a inverted frustoconical element formed of three layers of metal mesh. The second foaming screen can be formed of two layers of metal mesh placed over a discharge outlet of the swirl chamber.

24 Claims, 3 Drawing Sheets

70a
70
70b
69
74
50
63
C
73
78
80
72a
69
72b
65
61
78a
V
79
81
72
68b
66
76
82a
60
68
62
82
82b
68a
75
67
102
101
71
91
94
90
100
93
92
83

FOAM-GENERATING ASSEMBLY AND FOAM GENERATOR USED THEREIN

CROSS-REFERENCE TO RELATED APPLICATION

The present application claims the benefit of U.S. Provisional Application No. 60/566,327, filed Apr. 29, 2004, the contents of which are incorporated herein by reference.

BACKGROUND AND SUMMARY OF THE INVENTION

This application is directed to a foam-generating assembly for generating a foam particularly useful in preventing or extinguishing fires, and to a foam generator which is employed therein. It is also directed to a new method for generating a nitrogen-containing foam.

It is well known to use foams, and in particular foams containing nitrogen gas, to prevent or extinguish fires—see, for example, U.S. Pat. No. 6,112,819. Various constructions of apparatus for generating such foams have been devised. However, these known constructions are complicated and expensive to produce. The present inventors have developed a foam-generating apparatus which is simple in construction and inexpensive to produce, which will rapidly produce a nitrogen-containing foam of a desired expansion ratio, and which in one embodiment is sufficiently compact that it can be installed in an enclosed space, such as in an engine compartment or passenger cabin of a vehicle, airplane, boat, etc., to rapidly emit a fire preventing or extinguishing foam in the event of an impending or actual accident.

The inventive foam-generating assembly includes a foam generator and tanks which respectively contain a foamable aqueous liquid and nitrogen gas and which are connected to deliver their contents to the foam generator. The foam generator includes a header that defines a swirl chamber formed by a outer cylindrical wall, an inner cylindrical wall and a floor, and a spray nozzle is located in the center of its floor to emit a conical spray of the foamable aqueous liquid into the swirl chamber. An orifice is provided in the inner cylindrical wall to tangentially discharge nitrogen gas into the swirl chamber and around the spray nozzle and the liquid spray emitted therefrom to create a vortex flow of mixed liquid spray and gas. First and second mesh screens are provided through which the vortex flow will pass, first to provide a coarse foam and then a fine foam having the desired expansion ratio.

In one embodiment an extender tube can be positioned against the upper cylindrical wall to extend beyond the header and the first mesh screen, which can be in the form of an inverted frustoconical element, can be positioned in the extender tube, whereas the second mesh screen can be positioned across the outlet end of the extender tube. The outer cylindrical wall can have a larger diameter than the inner cylindrical wall, providing an annular ledge on which the extender tube is seated. The tanks can be spaced apart from the header and connected thereto by suitable conduits. A pressure regulator can be inserted in the gas conduit to control the pressure of gas delivered to the header.

In another embodiment, which provides a compact arrangement that enables the assembly to be installed in a compact space such as an engine compartment, the header can provide docking stations for the tanks and include passageways to deliver foamable aqueous liquid to the spray nozzle and nitrogen gas to the orifice in the inner cylindrical wall of the swirl chamber. A pressure regulator can be attached to the header to provide control of the nitrogen gas pressure delivered to the swirl chamber. An on-off control valve which can be electrically controlled can be included to allow gas to flow from the nitrogen tank to the header, e.g., when a signal is received from a sensor in the vehicle in which the foam-generating assembly is located that senses rapid deceleration of the vehicle (indicating impending crash). The tank containing the foamable aqueous liquid can include a flexible bag in which the liquid is contained, and a conduit from the nitrogen tank can be connected to the liquid tank to provide the pressure therein that causes the liquid to be delivered from the bag into the header.

The method of the invention involves tangentially flowing nitrogen gas around an expanding cone-shaped spray of foamable aqueous liquid in a cylindrical swirl chamber to provide a vortex and then passing the liquid spray and nitrogen gas through first and second spaced mesh foaming screens to provide a fine foam that can rapidly spread out from the swirl chamber and cover nearby areas to prevent or suppress fires.

The invention will now be better understood by reference to the attached drawings, taken in conjunction with the following discussion.

DETAILED DESCRIPTION OF THE PREFERRED EMBODIMENTS

Figure 1:
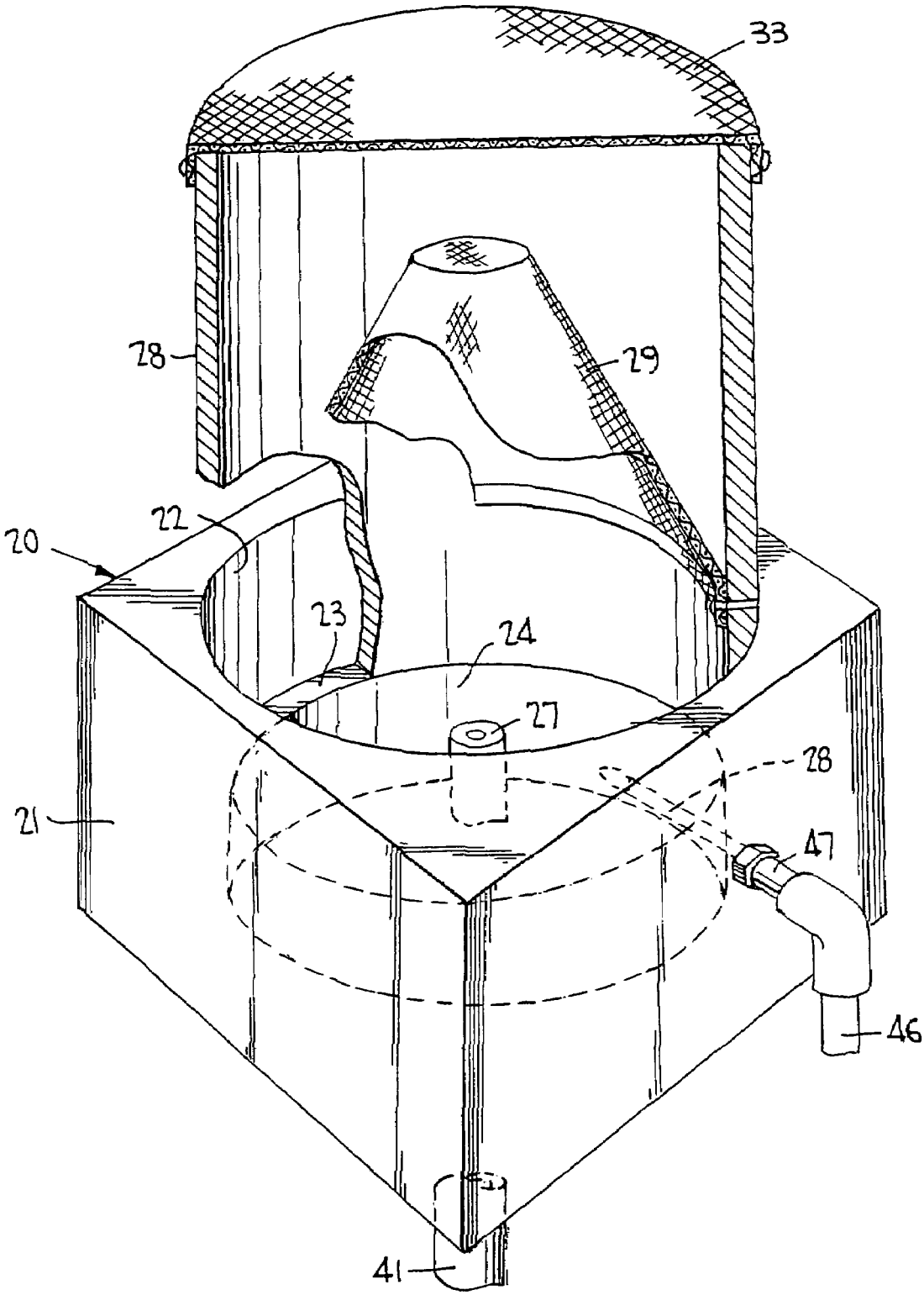
FIG. 1 shows a perspective view of a foam generator used in a first embodiment of a foam generating assembly according to this invention, certain elements thereof being broken away to show internal details.
Figure 2:
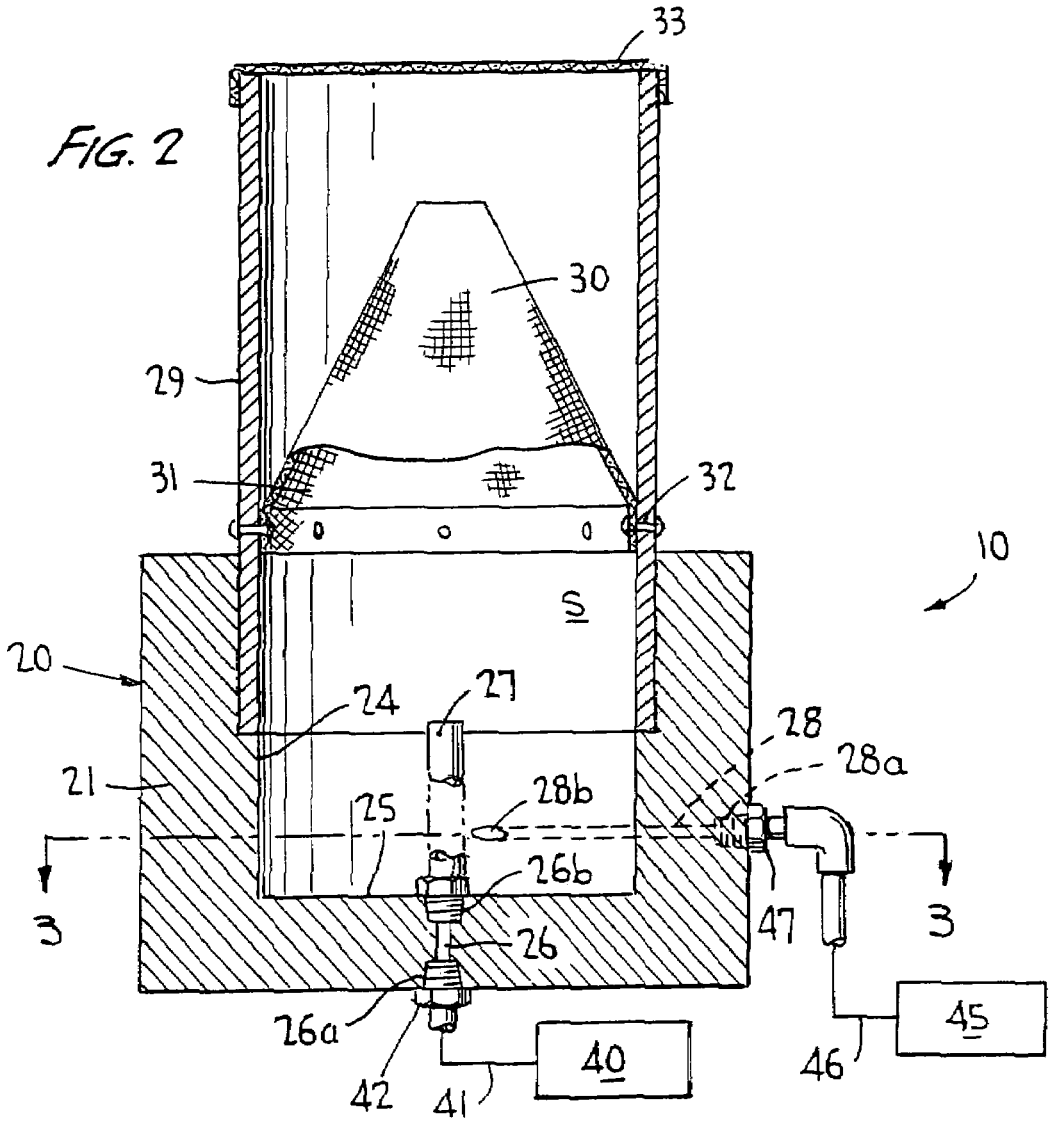
FIG. 2 shows a schematic view of the first embodiment of foam generating assembly of the invention, including a vertical cross sectional view of the foam generator of FIG. 1.
Figure 3:
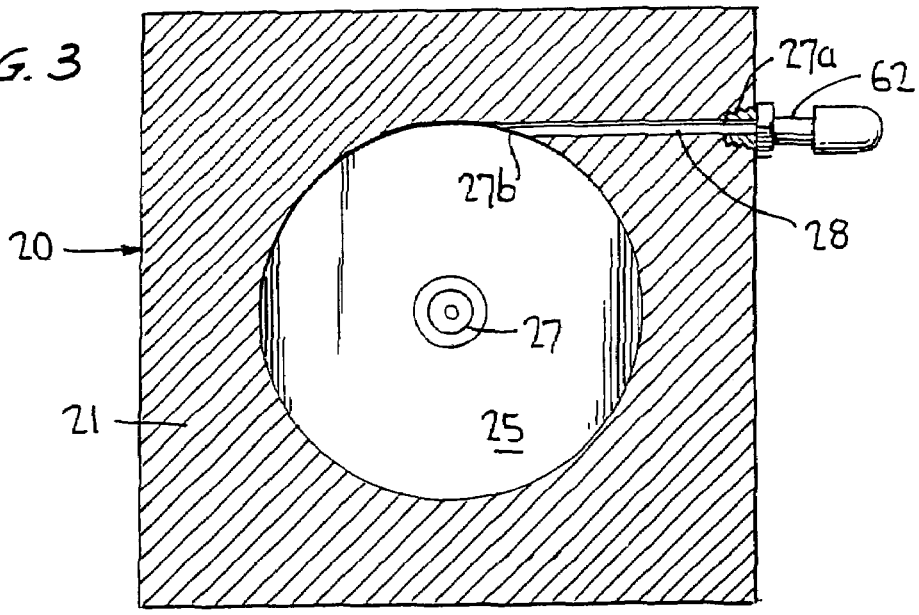
FIG. 3 is a cross-sectional view of the foam generator shown along line 3-3 in FIG. 2.

A first embodiment of the inventive foam-generating assembly 10 is shown in FIGS. 1-3. It includes a foam generator 20 (FIG. 1-3), a tank 40 containing a foamable aqueous liquid and a tank 45 containing nitrogen gas (see FIG. 2).

The foam generator 20 includes a header 21 which is hollowed out from its top to provide an internal swirl chamber S defined by an outer cylindrical wall 22, an inner cylindrical wall 24, and a floor 25. The header 21 is preferably a block of metal such as aluminum. The outer cylindrical wall 22 has a greater diameter than the inner cylindrical wall 24 so as to provide an annular ledge 23 therebetween. In a preferred embodiment the outer cylindrical wall had a diameter of 64 mm and extended a depth of 38 mm into the header, and the inner cylindrical wall 24 had a diameter of 61 mm and extended a further depth of 13 mm into the header.

As best seen in FIG. 2, a first passageway 26 extends upwardly from an internally threaded inlet end 26*a* in the bottom surface of the header to an internally threaded outlet end 26*b* in the center of the floor 25. A spray nozzle 27, such as a BETE WL ¼ spray nozzle, is threadingly engaged in the outlet end 26*b* and a connector 42 is threadingly engaged in the inlet end 26*a*. The connector 42 is located at the end of a valved conduit 41 that communicates with the foamable aqueous liquid-supply tank 40, which is spaced from the foam generator 20. Foamable aqueous liquid, such as ANSULITE®3×3 made by Ansul Incorporated of Marinette, Wis., can flow from the tank 40 through the conduit 41 to spray nozzle 27 and be discharged centrally into swirl chamber S.

A second passageway 28 extends from an internally threaded inlet end 28*a* in the side surface of the header to an elongated outlet orifice 28*b* in the inner cylindrical wall 24. The outlet orifice 28*b* is tangentially oriented relative to the inner cylindrical wall. A connector 47 which is located at the end of a valved conduit 46 that communicates with the nitrogen supply tank 45, is threadingly engaged in the inlet end 28*a*. Nitrogen from tank 45, which is spaced from the foam generator 20, can flow through the conduit 46 and the passageway 28 to tangentially enter the swirl chamber S and flow around the spray nozzle 27 and the liquid spray emitted therefrom to provide a vortex flow and a mixture of droplets of foamable aqueous liquid and nitrogen gas beyond the spray nozzle 27.

The foam generator 20 also includes an extender tube 29 which sits on annular ledge 23 and extends beyond the upper end of the header 21. The extender tube can be sized to pressure fit against the upper cylindrical wall 22, or it can be connected to the header 21 by circumferentially spaced screws (not shown). A first foaming screen 30 is positioned within the extender tube to cause the vortex of gas and droplets of aqueous liquid contacting the screen and passing there-through to form a course nitrogen-containing foam (containing large bubbles). This first foaming screen is configured as an inverted frusto-conical element, and is preferably made of three layers 31 of metal mesh. The first foaming screen could alternatively be formed in the shape of a simple cone. Each mesh layer is preferably made of aluminum and has a 1.6×2.0 mm mesh size. The first foaming screen 30 is connected to the extender tube 28 by circumferentially spaced screws 32 or other suitable connectors.

A second foaming screen 33 extends across the outer end of the extended tube 28 and is connected at its periphery to the extender tube by suitable means such as circumferentially spaced screws (not shown). This foaming screen is preferably made of two layers of the same mesh as used in the layers of the first foaming screen. Coarse nitrogen-containing foam contacting and passing through the second foaming screen will be converted into a fine foam having an expansion ratio of, e.g., 160 to 250, and is very effective in spreading out from the foam generator to cover nearby areas and prevent or suppress fires. This foam-generating assembly is capable of producing 450 liters of foam in about 70 seconds from a 6.4 liter/second flow of nitrogen gas and a 0.029 liter/minute flow of foamable solution.

Figures 4, 5, 6:
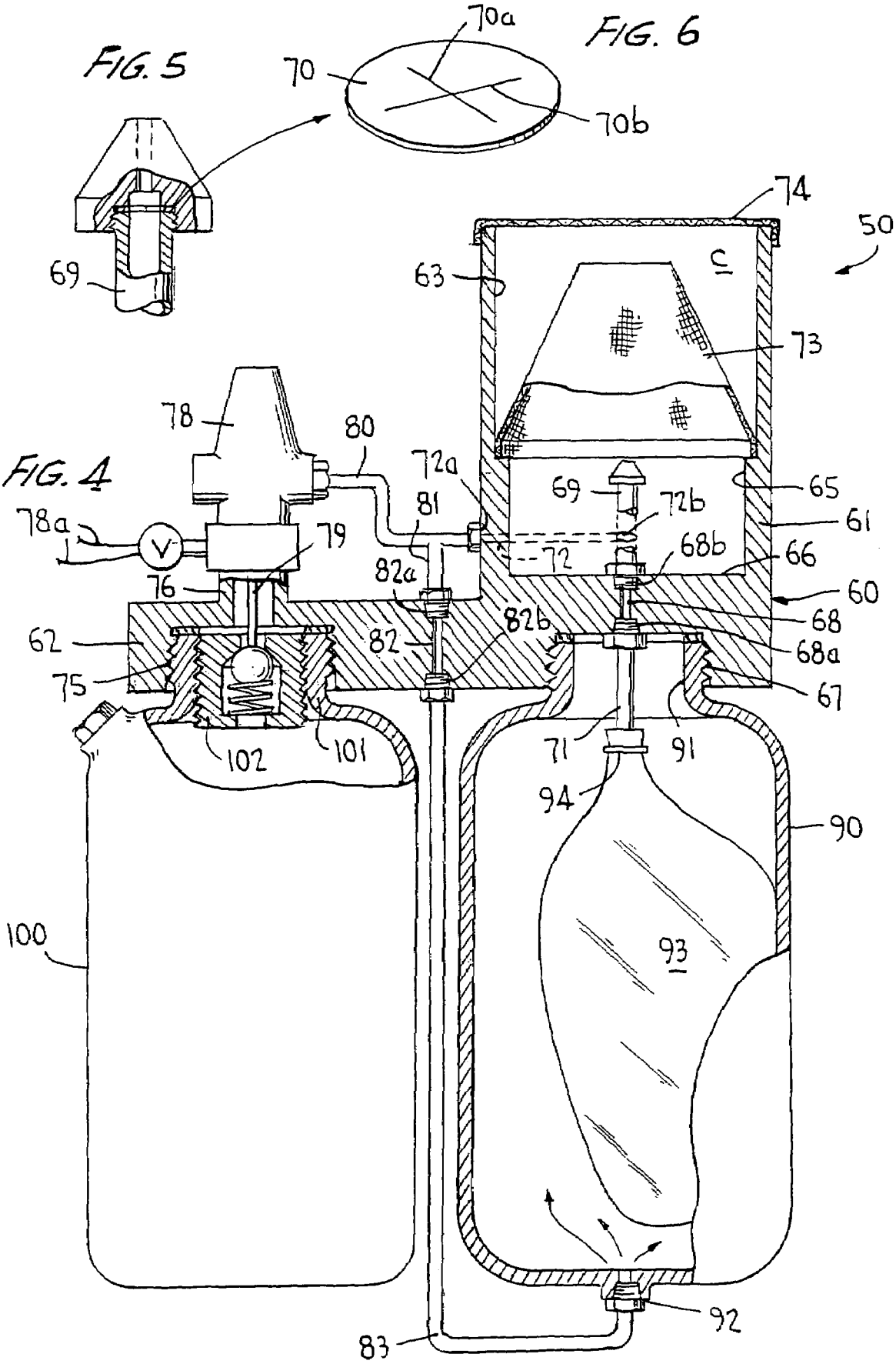
FIG. 4 is a side view of second embodiment of a foam generating assembly according to this invention, certain elements being broken away to show internal details.
FIG. 5 is an enlarged side view of an upper portion of the spray nozzle used in the foam generating assembly of FIG. 4.
FIG. 6 is a perspective view of the seal element in the spray nozzle of FIG. 5.

A second embodiment of a foam generating assembly 50 is shown in FIG. 4. It includes a foam generator 60, an aqueous liquid supply tank 90 and a nitrogen tank 100.

The foam generator 60 includes a header 61 having a lateral docking extension 62, the header being hollowed out from its outer end to provide an internal swirl chamber C defined by an outer cylindrical wall 63, an inner cylindrical wall 65 and a floor 66. The header is preferably made of steel. The outer cylindrical wall 63 has a greater diameter than the inner cylindrical wall 65 so as to define an annular ledge 64 therebetween.

A first internally threaded blind bore 67 is formed in the bottom of header 61 beneath the swirl chamber to provide a first docking station, and a first passageway 68 extends from an internally threaded inlet end 68*a* in the bottom of the blind bore 67 to an internally threaded outlet end 68*b* at the center of the floor 66. A spray nozzle 69 is threadingly engaged in the outlet end 68*b* so as to spray an aqueous liquid passing therethrough into the center of the swirl chamber C. As indicated in FIGS. 5 and 6, the spray nozzle 69 includes a seal element 70 with weakening lines 70*a*, 70*b*. The seal element 70 will prevent liquid flow through the spray nozzle until the liquid reaches a predetermined pressure, at which time the weakening lines will rupture and the flap areas adjacent thereto will bend to allow liquid flow therethrough. A flow pipe 71 is threadingly engaged in the inlet end 68*a* and extends into the blind bore 67.

A second passageway 72 extends from an internally threaded inlet end 72*a* in the side of the header 61 to an outlet orifice 72*b* in the inner cylindrical wall 65 of the swirl chamber, the outlet orifice being tangentially oriented so as to emit gas therefrom in a tangential fashion around the spray nozzle 69.

A first foaming screen 73 (similar in construction to the foaming screen 29) is fixedly positioned on the annular ledge 64 and a second foaming screen (similar in construction to the foaming screen 33) is positioned across the outer end of the header 61. No extender tube is used.

A second internally threaded blind bore 75 is formed in the lateral docking extension 62 opposite a nipple 76. A third passageway 77 communicates with the base of the blind bore 75 and extends into the nipple 76. A valved pressure regulator 78 is attached to the nipple 76 and includes a control pin 79 that extends through the third passageway and into the blind bore 75. A conduit 80 connects with the inlet end 72*a* of the second passageway 72. A branch conduit 81 connects with an inlet end 82*a* of fourth passageway 82, and a pipe 83 connects with the outlet end 82*b* for connection to the bottom end of the tank 90.

The aqueous liquid supply tank 90 includes a threaded neck 91 that can sealingly engage in the blind bore 67 and a threaded inlet channel 92 in its bottom to which the pipe 83 can be connected. A flexible bag 93 is located in the tank and is sealingly connectable to the flow pipe 71 by clamp 94. This pouch can contain foamable aqueous liquid that can be discharged through the flow pipe 71 and first passageway 68 when pressurized by gas flowing into the tank via inlet channel 92. The bag 93 can be refilled with foamable aqueous liquid without removing the tank 90 from the first docking station by removing spray nozzle 69 and sealingly attaching a conduit to the outlet end 68*b* so as to supply foamable aqueous liquid under pressure to the first passageway 68 and back into the bag.

The nitrogen tank 100 includes a threaded neck 101 that can sealingly engage in the blind bore 75 and a spring-biased ball valve 102 is sealingly positioned in its neck. The ball valve can be opened by movement of the control pin 79 against the ball when the on-off valve of the pressure regulator 78 is opened. This can be done manually or electrically (note wires 78*a* which can be connected to a vehicle switch that activates one or more air bags in the event of rapid deceleration of the vehicle in which the foam-generating assembly is employed). Opening of the ball valve 102 will cause nitrogen from tank 100 to flow to and through passageway 72 to outlet orifice 72*b*, where it will tangentially enter the swirl chamber C, as well as to flow through pipe 83 to tank 90, where it will cause foamable aqueous liquid from bag 93 to flow through the spray nozzle 69 (after seal element 70 is ruptured) into the swirl chamber C. A gas-containing foam will be produced as explained previously relative to the first invention embodiment.

Although two specific embodiments of foam-generating assemblies and foam generators have been shown and described in detail, modifications therein can be made and still fall within the scope of the appended claims.

We claim:

1. A foam-generating assembly comprising:

a foam generator which includes a header that is hollowed out to provide a swirl chamber defined by an outer cylindrical wall, an inner cylindrical wall and a floor; a first passageway that extends from an inlet end to an outlet end at the center of said floor, a spray nozzle connected to said outlet end of said first passageway for emitting a spray of aqueous liquid into the center of said swirl chamber; a second passageway that extends from an inlet end to an outlet orifice in said inner cylinder wall for emitting a tangential flow of gas into the swirl chamber and around said spray of aqueous liquid so as to create a vortex flow of a mixture of gas and aqueous liquid droplets; a first foaming screen through which said vortex flow of a mixture of gas and aqueous liquid droplets will pass to form a coarse gas-containing foam, and a second foaming screen through which said coarse foam will pass to provide a fine foam;

a first tank containing foamable aqueous liquid communicating with said inlet end of said first passageway, and a second tank containing pressurized gas in communication with said inlet end of said second passageway.

2. A foam-generating assembly according to claim 1, wherein said second tank contains nitrogen.

3. A foam-generating assembly according to claim 1, wherein said foam generator includes an extender tube which fits against said outer cylindrical wall of said header and extends beyond said header.

4. A foam-generating assembly according to claim 3, wherein said outer cylindrical wall has a larger diameter than said inner cylindrical wall so as to define an annular ledge therebetween, and wherein said extender tube is seated on said annular ledge.

5. A foam-generating assembly according to claim 3, wherein said first foaming screen fits within said extender tube and said second foaming screen extends across an outer end of said extender tube.

6. A foam-generating assembly according to claim 5, wherein said first foaming screen is an inverted frustoconical element formed of three layers of metal mesh.

7. A foam-generating assembly according to claim 6, wherein said second foaming screen is formed of two layers of metal mesh.

8. A foam-generating assembly according to claim 1, wherein said header defines a first docking station for said first tank and a second docking station for said second tank.

9. A foam-generating assembly according to claim 8, wherein first docking station is a first blind bore, and wherein said first tank defines a neck which sealingly fits in said first blind bore.

10. A foam-generating assembly according to claim 9, wherein said first tank includes a flexible bag for containing said aqueous liquid and wherein said flexible bag is in communication with said inlet end of said first passageway.

11. A foam-generating assembly according to claim 10, wherein said second docking station is a second blind bore, and wherein said second tank defines a neck which sealingly fits in said second blind bore.

12. A foam-generating assembly according to claim 11, including a pressure regulator attached to said header for controlling flow of gas from said second tank to said inlet end of said second passageway.

13. A foam-generating assembly according to claim 12, wherein said pressure regulator includes an on-off control valve and wherein second tank includes a ball valve in said neck thereof that can be opened by opening of said on-off valve of said pressure regular.

14. A foam-generating assembly according to claim 12, including conduit means for delivering pressurized gas to said first tank to pressurize said flexible bag therein and cause aqueous liquid in the flexible bag therein to be delivered to said first passageway.

15. A foam-generating assembly according to claim 8, wherein said outer cylindrical wall has a larger diameter than said inner cylindrical wall so as to provide an annular ledge therebetween, and wherein said first foaming screen is seated on said annular ledge.

16. A foam-generating assembly according to claim 15, wherein said first foaming screen is in an inverted frustoconical element formed of three layers of metal mesh.

17. A foam generator which comprises a header that is hollowed out to provide a swirl chamber defined by an outer cylindrical wall, an inner cylindrical wall and a floor; a first passageway that extends from an inlet end to an outlet end at the center of said floor, a spray nozzle connected to said outlet end of said first passageway for emitting a spray of aqueous liquid into the center of said swirl chamber; a second passageway that extends from an inlet end to an outlet orifice in said inner cylindrical wall for emitting a tangential flow of gas into the swirl chamber and around said spray of aqueous liquid so as to create a vortex flow of a mixture of gas and aqueous liquid droplets; a first foaming screen through which said vortex flow of a mixture of gas and aqueous liquid droplets will pass to form a coarse gas-containing foam, and a second foaming screen through which said coarse foam will pass to provide a fine foam.

18. A foam generator according to claim 17, including an extender tube which fits against said outer cylindrical wall and extends beyond said header.

19. A foam generator according to claim 18, wherein said outer cylindrical wall has a larger diameter than said inner cylindrical wall so as to define an annular ledge therebetween, and wherein said extender tube is seated on said annular ledge.

20. A foam generator according to claim 19, wherein said first foaming screen fits within said extender tube and said second foaming screen extends across an outer end of said extender tube.

21. A foam generator according to claim 19, wherein said first foaming screen is an inverted frustoconical element formed of three layers of metal mesh.

22. A foam generator according to claim 17, wherein said header includes a first blind bore opposite said swirl chamber that provides a docking station for a first tank and a second blind bore that provides a docking station for a second tank.

23. A foam generator according to claim 22, wherein said first tank contains a flexible bag that can contain aqueous liquid and is in communication with said inlet end of said first passageway and wherein said second tank can contain nitrogen and is in communication with said inlet end of said second passageway.

24. A foam generator according to claim 23, including a pressure regulator for controlling the pressure of nitrogen supplied to said second passageway.

* * * * *